US010420410B2

(12) United States Patent
Chevalier et al.

(10) Patent No.: US 10,420,410 B2
(45) Date of Patent: Sep. 24, 2019

(54) APPLICATOR DEVICE AND SYSTEM FOR PACKAGING AND APPLYING A COSMETIC PRODUCT, AND USE OF SAME

(71) Applicant: L V M H RECHERCHE, Saint Jean de Braye (FR)

(72) Inventors: Marc Chevalier, Franconville (FR); Jean-François Tranchant, Marigny-les-Usages (FR); Emilie Gombard, Orleans (FR)

(73) Assignee: LVMH Recherche, Saint Jean de Braye (FR)

( * ) Notice: Subject to any disclaimer, the term of this patent is extended or adjusted under 35 U.S.C. 154(b) by 173 days.

(21) Appl. No.: 14/655,647

(22) PCT Filed: Dec. 3, 2013

(86) PCT No.: PCT/FR2013/052930
§ 371 (c)(1),
(2) Date: Jun. 25, 2015

(87) PCT Pub. No.: WO2014/102475
PCT Pub. Date: Jul. 3, 2014

(65) Prior Publication Data

US 2015/0320179 A1 Nov. 12, 2015

(30) Foreign Application Priority Data

Dec. 26, 2012 (FR) ..... 12 62807

(51) Int. Cl.
*A45D 40/26* (2006.01)
*A45D 34/04* (2006.01)

(52) U.S. Cl.
CPC ..... *A45D 40/265* (2013.01); *A45D 34/042* (2013.01); *A45D 34/045* (2013.01);
(Continued)

(58) Field of Classification Search
CPC ..... A45D 2200/157; A45D 2200/155
(Continued)

(56) References Cited

U.S. PATENT DOCUMENTS

2005/0058496 A1* 3/2005 De La Poterie ..... A45D 2/48 401/1
2007/0286831 A1* 12/2007 Kamada ..... A45D 40/262 424/70.7

(Continued)

FOREIGN PATENT DOCUMENTS

EP 1 827 160 B1 11/2010
FR 2913319 A1 9/2008

(Continued)

OTHER PUBLICATIONS

International Search Report Application No. PCT/FR2013/052930 report dated Jul. 10, 2014.

*Primary Examiner* — Tatiana L Nobrega
(74) *Attorney, Agent, or Firm* — Miller, Matthias & Hull LLP

(57) ABSTRACT

The invention relates to an applicator device for applying a cosmetic product, comprising an elongate applicator head equipped with a groove having a straight portion substantially parallel to the longitudinal axis of the head, said groove containing a rectilinear resistive heating wire extending over the entire length of the straight portion of the groove.

15 Claims, 3 Drawing Sheets

(52) U.S. Cl.
CPC ..... *A45D 40/262* (2013.01); *A45D 40/267* (2013.01); *A45D 2200/157* (2013.01)

(58) Field of Classification Search
USPC ..... 401/1, 122
See application file for complete search history.

(56) References Cited

U.S. PATENT DOCUMENTS

| | | | | |
|---|---|---|---|---|
| 2008/0216857 | A1* | 9/2008 | Tranchant | A45D 40/267 132/218 |
| 2009/0194128 | A1* | 8/2009 | Vandromme | A46B 3/18 132/218 |
| 2012/0148328 | A1* | 6/2012 | Jollet | A45D 2/48 401/2 |
| 2013/0098387 | A1* | 4/2013 | Shimizu | A45D 1/18 132/217 |
| 2013/0104925 | A1* | 5/2013 | Caulier | A45D 40/262 132/218 |

FOREIGN PATENT DOCUMENTS

| | | | | |
|---|---|---|---|---|
| FR | 2961383 | * | 12/2011 | A45D 34/04 |
| GB | 2 448 039 | A | 10/2008 | |
| JP | 5 044038 | B | 10/2012 | |
| WO | WO 2006/043544 | A1 | 4/2006 | |

* cited by examiner

APPLICATOR DEVICE AND SYSTEM FOR PACKAGING AND APPLYING A COSMETIC PRODUCT, AND USE OF SAME

CROSS-REFERENCE TO RELATED APPLICATION

This Application is a 35 USC § 371 US National Stage filing of International Application No. PCT/FR2013/052930 filed on Dec. 3, 2013, and claims priority under the Paris Convention to French Patent Application No. 12 62807 filed on Dec. 26, 2012.

FIELD OF THE DISCLOSURE

The present invention relates to applicator devices and to systems for packaging and applying a cosmetic product intended to be heated, as well as to the uses of such systems.

BACKGROUND OF THE DISCLOSURE

More particularly, the invention relates to an applicator device for a cosmetic product, comprising:

a body suitable for being held in the hand;

an applicator head;

a wand connecting the body and the applicator head;

the applicator head comprising:

a main body defining a longitudinal axis and comprising a storage portion suitable for loading with product and an application portion suitable for applying the product, passages being provided between said storage portion and said application portion, the storage portion comprising a groove having a main portion defining an axis of extension, the main body of the head having a certain length along the longitudinal axis and the straight portion of the groove extending for a major portion of said length of the main body;

a heating device suitable for heating the cosmetic product loaded on the applicator head, the heating device comprising a heating element lying within said groove.

Document EP1827160A1 discloses an example of such an applicator device, where the heating element is in the form of a twisted or coiled resistance wire helically wound along its extension direction within the groove formed in the applicator head, around a support member of dielectric material. This applicator device has the disadvantage of requiring considerable energy to heat the resistance wire because of its great length, which implies the use of a high power energy source to heat the wire to the desired temperature in order to melt the cosmetic product loaded on the applicator head. When this power source is integrated into the product packaging and application system, and more particularly into the applicator device, it is necessary to provide a housing of sufficient size to accommodate this source of energy, which places significant constraints on the applicator device in terms of size and design.

Moreover, the use of a twisted resistance wire as the heating element in the applicator head also has the disadvantage of requiring a relatively long heating time, about 30 seconds for a head having a length of about 15 to 20 mm for example, until it reaches a temperature sufficient to melt the cosmetic product loaded on the applicator head, making it tedious to use an applicator device equipped with such an applicator head.

In addition, as a twisted resistance wire occupies a significant volume, its integration within the applicator head generates significant conceptual and design constraints.

Finally, the applicator head described in this document EP1827160A1 is highly complex and is inspired by the heating heads of eyelash curlers, which are well known for curling the eyelashes solely with heat, particularly in Asia. These heads are not suitable for both heating and applying a cosmetic product to the eyelashes. As mentioned above, in this type of applicator head, the twisted resistance element is usually placed in a central groove of significant width, which imposes stringent constraints, particularly in terms of applicator head design.

This type of heating head has many other disadvantages, as it can only heat the product on one side of the applicator head and the liquid product once heated is very poorly distributed and therefore very poorly spread out over the head. As a result, the liquid product is not fully applied and accumulates on and around the resistance element.

In addition, the combing means, typically teeth that form a brush, are not very effective because they have to be located on a given area of the head and have no direct fluid communication with the central groove.

Finally, in this type of applicator head, it is not easy to supply cosmetic product to the groove where the resistance element is located, because it is necessary to have a second dedicated device.

SUMMARY OF THE DISCLOSURE

The present invention is intended to overcome these disadvantages.

To this end, the invention proposes an applicator device of the aforementioned type characterized in that the heating element comprises a resistance wire having a main portion extending along the axis of extension of the main portion of the groove, for the entire length of said main portion of the groove.

Thus, in the applicator device of the invention, the main portion of the resistance wire forming the heating element extends for the entire length of the main portion of the groove along its axis of extension. In other words, the resistance wire forming the heating element has in its main portion a shape corresponding to the main portion of the groove. Also, if the axis of extension of the main portion of the groove defines for example a curve, a zigzag, or a straight line, the main portion of the resistance wire will have a corresponding curved, zigzag, or straight shape.

With these arrangements, the rise in temperature of the heating element to a temperature sufficient to melt the cosmetic product loaded on the applicator head can be achieved much more quickly and can require less energy than applicator heads of the prior art.

Indeed, as the shape of the main portion of the resistance wire used on the applicator head according to the invention corresponds to the shape of the main portion of the groove in which it is arranged, its length can be reduced in comparison to the twisted wire used in prior art applicator heads, allowing a faster temperature increase and requiring less energy than existing devices.

In addition, with such a non-twisted resistance wire, the temperature cools back down more quickly than with a twisted resistance wire, which prevents heating the unheated product contained in a reservoir when the applicator head is to be reloaded with product and is inserted into this product reservoir. This avoids unnecessarily subjecting the cosmetic product contained in this reservoir to repeated cycles of heating/cooling which could alter its physicochemical properties.

Moreover, the use of such a heating element allows greater freedom in the design of the applicator head, especially in terms of shape and dimension, in particular to allow providing combing means/product application means as effective as the brushes of the applicator heads of the prior art that have no heating element, in order to maintain an optimal user experience.

In preferred embodiments of the invention, one or more of the following arrangements may be used:

the main portion of the resistance wire lies at the bottom of the main portion of the groove;

the main portion of the groove extends for at least 80% of the length of the main body;

the main portion of the groove extends for substantially the entire length of the main body;

the axis of extension of the main portion of the groove is parallel to the longitudinal axis of the main body. Thus, if the main body of the applicator head has a longitudinal axis that is for example rectilinear, continuously curved, or wavy, then the axis of extension of the main portion of the groove, which receives the main portion of the resistance wire, will be parallel to said longitudinal axis and will have the same profile (rectilinear, continuously curved, or wavy for example).

the application portion comprises at least one row of teeth aligned in an alignment direction substantially parallel to the longitudinal axis, the passages being formed by and/or opening into the spaces between the teeth;

the main portion of the groove is straight and the main portion of the resistance wire is rectilinear.

the main body has a first end connected to the wand and a second free end, the groove has the shape of a U comprising a base and two arms, said base being at the free end of the main body and said arms forming two main portions, and the heating element has a U shape which corresponds to that of said groove;

the groove lies in a plane containing the longitudinal axis and perpendicular to the row of teeth of the application portion;

the groove lies in a plane distanced from the longitudinal axis and parallel to the row of teeth of the application portion;

the row of teeth has the general shape of a U centered on the longitudinal axis, the storage portion comprises two grooves that run one on each side of the row of teeth, and the heating device comprises two heating elements that lie within said grooves;

the storage portion has a recess intended for receiving a temperature sensor;

the applicator device further comprises a power supply device for supplying electric power to the heating element.

The invention also relates to a system for packaging and applying a cosmetic product, comprising:

a reservoir for containing said cosmetic product and having a neck defining a longitudinal axis; and an applicator device as described above, wherein the body is suitable for closing the reservoir and the elongate wand is suitable for insertion into said reservoir when said body is closing said reservoir.

One of the major problems typically associated with cosmetic product applicators using a heating applicator head is that after application, some product always remains on the applicator head at or near the heating element. This residual product is inevitably reheated but is also brought into contact with product that has never been heated when the applicator head is plunged back into the reservoir to be reloaded with product. This is an undesirable phenomenon and should therefore be minimized as much as possible. The cosmetic product may lose its properties when heated multiple times, the mixture of heated and unheated product may cause lumps to form within the reservoir and/or on the applicator head, and lastly the applicator head eventually becomes clogged. There is therefore a need for a device that measures out the amount of product to be heated and then minimizes the accumulation on the applicator head after application, particularly at the heating element.

Thus, in a particular embodiment of the system for packaging and applying a product according to the invention, the neck of the reservoir is provided with a wiper member intended for wiping at least the applicator head. Such a wiper member removes excess product loaded on the applicator head and leaves a calibrated amount of product to be heated in a predetermined area of the applicator head, namely in its product storage portion.

In an advantageous arrangement, the applicator head has a non-circular cross section, and the wiper member comprises an insertion opening having a cross-section substantially corresponding to the combined cross-sections of the wand and applicator head, said wiper member further comprising a wiper lip suitable for removing the excess cosmetic product loaded on the wand and applicator head as the applicator device is withdrawn from the reservoir. The insertion opening thus guides and directs the user insertion of the applicator head and wand into the reservoir. The wiper opening eliminates the excess product loaded on the applicator head and leaves on said head, and in particular in the storage portion thereof, a calibrated amount of product to be heated.

Preferably, the wiper member is mounted so as to rotate freely within the neck of the reservoir, and said wiper member and the applicator device comprise indexing elements suitable for mutually indexing the wiper member and applicator device rotationally. This ensures that the applicator head, having a non-circular cross-section, is always aligned angularly with the corresponding wiper opening and insertion opening of the wiper member when the applicator device is inserted into the reservoir.

According to a particularly advantageous embodiment of the packaging and application system of the invention, the reservoir contains a cosmetic product in powder form intended to be heated for application to keratin fibers, particularly eyelashes.

This cosmetic product in powder form may be mascara.

The term "mascara" is understood to mean a cosmetic composition intended for application to keratin fibers. Mascara is particularly intended for makeup or cosmetic treatment to be applied to keratin fibers such as human keratin fibers (eyelashes, eyebrows, hair) and false eyelashes. It may be a cosmetic base coat, a composition for application onto a base coast (top coat), or a composition for cosmetic treatment of keratin fibers.

Advantageously, the mascara is anhydrous. Anhydrous is understood to mean that water is not added during manufacture of the mascara. Trace water may, however, remain in the mascara, particularly less than 5%, and preferably less than 3% by weight relative to the weight of the composition.

Preferably, the mascara is a powder consisting of particles of an average diameter of between 1 μm and 10 mm, preferably between 20 μm and 1 mm.

The powder particles are preferably solid at room temperature (25° C.), and the mascara preferably has a melting point of between 35 and 70° C., more preferably from 40 to 50° C.

The mascara advantageously comprises at least a first polymer, preferably film-forming, having a melting point of between 35 and 70° C.

Preferably, the mascara further comprises a second polymer, preferably film-forming, having a melting point of between 80 and 150° C.

The mass ratio between the first polymer and the second polymer is advantageously between 1 and 20, preferably between 3 and 16, and more preferably between 4 and 10.

The total amount of the first polymer and of the second polymer when present is between 40 and 95% by weight, and preferably between 70 and 80% by weight, of the total weight of the mascara.

According to a first implementation, the mascara contains at least two polymers, preferably film-forming, the first polymer being selected from among the copolymers of vinylpyrrolidone (VP) and an alkene, preferably from among the copolymers VP/eikosene, VP/hexadecene, VP/triacontene, VP/styrene, preferably of a molecular weight between 15,000 and 20,000 g/mol, and the second polymer being selected from among the polyolefins, particularly the polybutenes, preferably having a mean molecular weight that is advantageously between 300 and 2500 g/mol.

According to a second implementation, the mascara contains two polymers, preferably film-forming, the first polymer being selected from among the polyalkylene glycols, example polyethylene glycols preferably having an average molecular weight of between 1000 and 3000 g/mol, and the second polymer being selected from among the polyvinylpyrrolidones (PVP), preferably the polyvinylpyrrolidones having an average molecular weight of between 10,000 and 100,000 g/mol, advantageously between 40,000 and 70,000 g/mol.

Advantageously, the mascara comprises from 1 to 25% by weight of at least one wax, preferably from 5 to 10% by weight, relative to the total weight of the mascara.

The mascara advantageously comprises from 5 to 30% by weight of pigment, preferably 10 to 25% by weight, relative to the total weight of the mascara.

The mascara further comprises preferably less than 5% by weight, preferably less than 3% by weight, of a compound that is liquid at room temperature, for example an oil or a volatile solvent such as isododecane, a cyclomethicone such as cyclopentasiloxane.

The mascara may also comprise any additive conventionally used in cosmetics such as a solid filler, antioxidants, preservatives, fragrances, cosmetic active agents for treatment of the fibers to which the mascara is applied such as emollients, moisturizers, vitamins, sunscreens, and mixtures thereof.

Examples of such mascara compositions in the form of a powder are presented in the French patent application FR1157552 filed on 26 Aug. 2011 by the Applicant.

Alternatively, the reservoir of the packaging and application system according to the present invention could contain a cosmetic product to be heated other than mascara, and to be applied to a surface other than keratin fibers, such as a foundation to be applied to the skin of a user in order to achieve a lifting effect. In the case of foundation, the temperature to which the product must be heated for application to the skin of the user is about 40° C.

Moreover, in such an example of an application of the system for packaging and applying a cosmetic product according to the invention, the product application portion of the applicator head may consist of an application surface that is for example flat, cylindrical, or curved, instead of the teeth forming the product application portion in the case of applying mascara to keratin fibers.

Finally, the invention also relates to the use of a packaging and application system as described above, for applying a cosmetic product in powder form to keratin fibers, particularly to eyelashes.

As a variant, the invention can also relate to the use of a packaging and application system as described above for applying a cosmetic product to the skin of a user, particularly to the face.

Other features and advantages of the invention will become apparent from the following description of one of its embodiments, given by way of non-limiting example with reference to the accompanying drawings.

BRIEF DESCRIPTION OF THE DRAWINGS

In the drawings.

In the various figures, the same references designate identical or similar elements.

DETAILED DESCRIPTION OF THE DISCLOSURE

Figure 1:
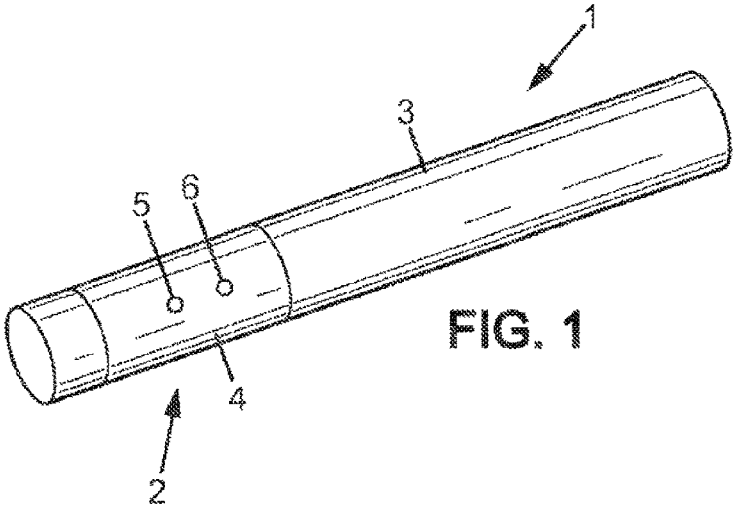
FIG. 1 is a perspective view of a system for packaging and applying a cosmetic product according to a first embodiment of the invention, the applicator device being in the storage position inside the reservoir.

FIG. 1 represents a system 1 for packaging and applying a cosmetic product, particularly mascara, comprising an applicator device 2 made for example of plastic, and a reservoir 3 that is itself made of plastic for example.

The applicator device 2 comprises a body 4 which forms a cap that closes the reservoir 3 when the applicator device 2 is in the storage position relative to the reservoir 3, and allowing a user to grip the applicator device 2 when said device is in the usage position, in other words when it has been withdrawn from the reservoir 3.

In the example shown, the cap 4 is provided with two indicator lights 5, 6 described below.

Figure 2:
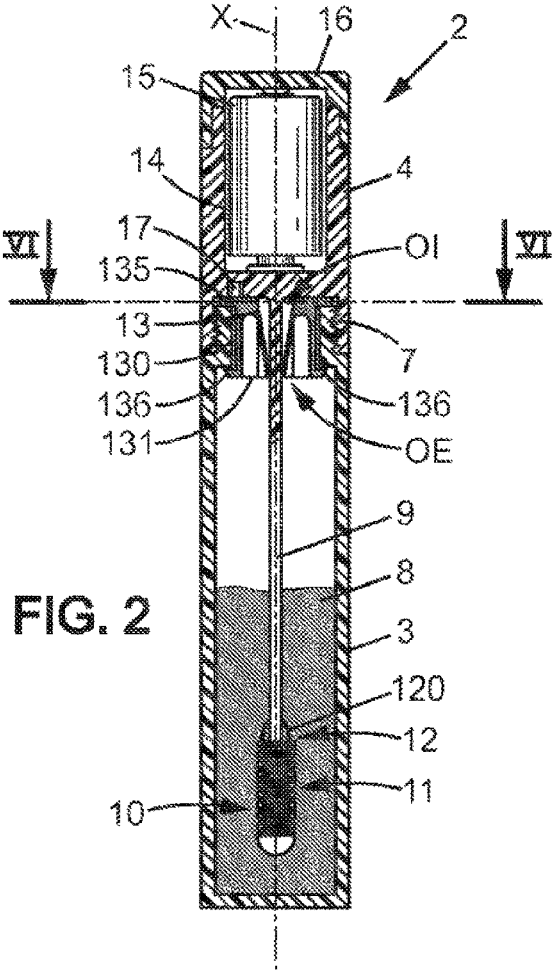
FIG. 2 is a longitudinal sectional view of the system of FIG. 1.
Figure 3:
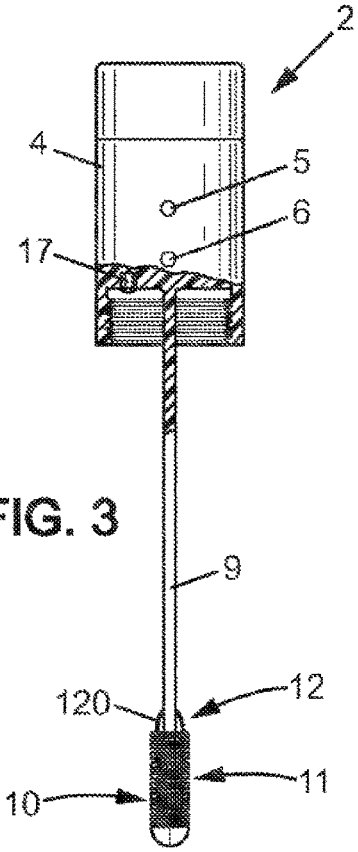
FIG. 3 is a longitudinal sectional view of the applicator device that is part of the system of FIGS. 1 and 2, in the usage position.

As represented in FIGS. 2 and 3, the cap 4 may be screwed or attached in some other manner to the neck 7 of the reservoir 3 containing a cosmetic product such as mascara 8 intended to be heated for application to keratin fibers, particularly eyelashes. In the exemplary embodiment represented, the cosmetic product 8 is mascara in the form of a powder in the unheated state, meaning at ambient temperature, and which melts when heated to a temperature between 35 and 70° C., preferably between 40 and 50° C., for application to keratin fibers in the form of a more or less viscous liquid.

The neck 7 of the reservoir 3 defines a longitudinal axis X and is equipped with a wiper member 13 intended to cooperate with the cap 4 to seal the reservoir 3 when said cap 4 is attached to the neck 7, and to remove the excess mascara carried by the applicator head 10 and/or the mascara adhering to the wand 9 when the applicator device 2 is withdrawn from the reservoir 3, as will be described in more detail with reference to FIG. 6.

Also in relation to these FIGS. 2 and 3, the cap 4 is extended by a wand 9 running from said cap 4 to a free end having an applicator head 10 intended for applying the product 8 to part of the user's body, particularly to the eyelashes when the cosmetic product 8 is mascara.

Figure 4:
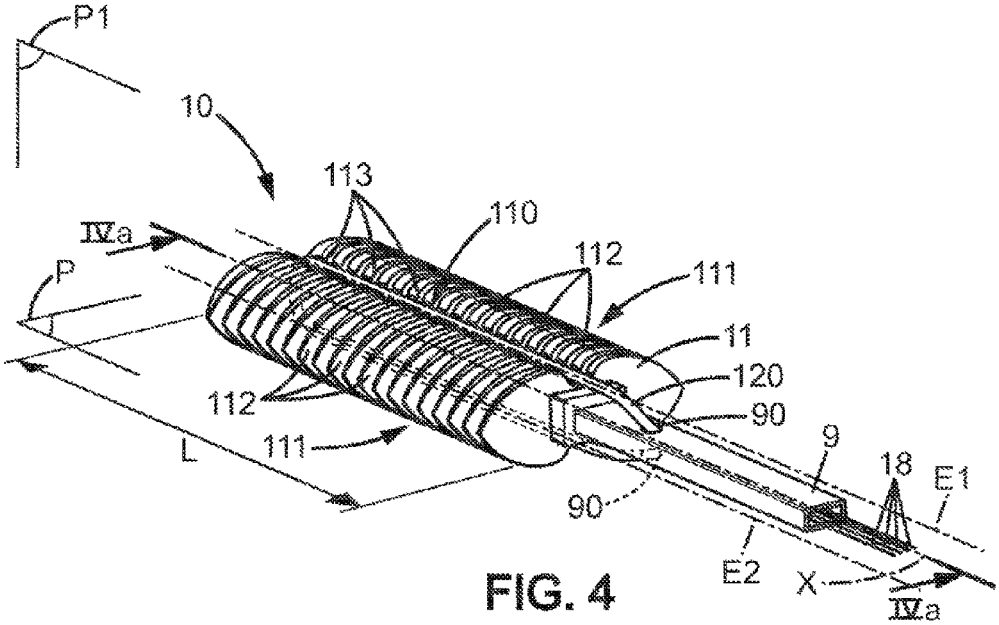
FIG. 4 is a perspective view of an applicator head that is part of the applicator device of FIG. 3.
Figure 4A:
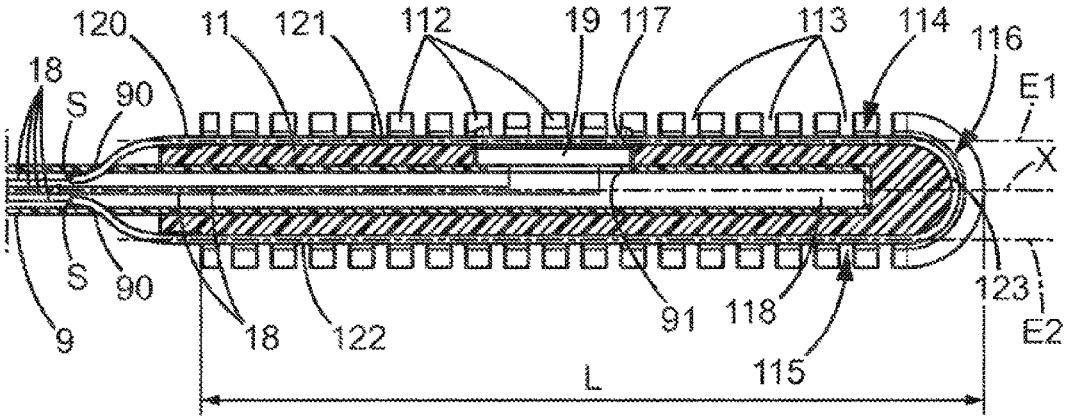
FIG. 4*a* is a sectional view along line IV-IV of FIG. 4.

The applicator head 10 comprises an elongate main body 11, having a first end connected to the wand and a second free end, and a heating device 12 comprising a heating element 120, and is described in more detail in relation to FIGS. 4 and 4*a*.

The cap 4 has a housing 14 containing one or more electrical batteries 15 forming a power supply device for supplying power to the heating element 120 of the applicator head 10 by means of conductors 18 extending along the wand 9. As illustrated in FIG. 2, the housing 14 may be open at the top and closed by a cover 16 that is attached to the cap 4 by screwing, snap-fitting, or the like. It is thus possible to access the housing 14 by detaching the cover 16 from the cap 4 to allow replacing the battery or batteries 15 when they are dead. Alternatively, the applicator device 2 could be provided with a connector to enable recharging the battery or batteries 15 from a power source external to the applicator device 2. The abovementioned indicator light 6 may be provided as a light-emitting diode which is red or some other color, and which is turned on when insufficient voltage is detected at the terminals of the battery 15.

Finally, the cap 4 may be equipped with a sensor 17, for example a contact sensor, positioned facing the neck 7 of the reservoir 3 so that said neck 7 presses against said sensor 17 when the cap 4 is closing the reservoir 3, in order to detect such closure.

As described in document FR2913319, this sensor 17 is intended for detecting the opening and closing of the reservoir 3 by the cap 4 in order to stop the supply of power to the heater 120 from the power supply device 15 when the applicator device 2 is in the storage position relative to the reservoir 3 and to supply power when said applicator device 2 is withdrawn from said reservoir 3. Thus, the heating element 120 of the applicator head 10 only begins heating when the sensor 17 has detected the removal of the cap 4 from the reservoir 3, which makes it possible to heat the applicator head 10 only when it is removed from the reservoir 3 and to avoid exposing the entire product 8 contained in the reservoir 3 to repeated heating/cooling cycles.

The above-mentioned indicator light 5 may, for example, consist of a light-emitting diode 5, in particular green or some other color, serially connected to the heating element 120 so as to indicate to the user that the heating element 120 is receiving power from the power supply device 15. The supply of power to the heating element 120 by the power supply device 15 may further be limited to a certain length of time by means of a timer, for example between 30 sec and 2 min, the indicator light 5 remaining on during this entire period. Alternatively, it would be possible to control the indicator light 5 so that it flashes while the temperature of the heating element 120 is climbing, meaning for a period of about ten seconds, then remaining constantly on for the rest of the time the heating element 120 is on.

Optionally, it could also be arranged to have a time delay, for example about 5 or 10 seconds, between when the sensor 17 detects the opening of the reservoir 3 and the time when the heating element 120 is electrically connected to the power supply device 15. This ensures that the user has time to withdraw the applicator head 10 from the reservoir 3 before the heating element 120 begins to heat.

As a variant, the applicator device 2 could be equipped with a manual switch allowing the user to manually control the closing and opening of the circuit enabling the heating element 120 to receive power from the power supply device 15.

As illustrated in FIG. 2, when the applicator device 2 is in the storage position relative to the reservoir 3, the cap 4 closes the reservoir 3 and the wand 9 and applicator head 10 extend into said reservoir 3 so that said head 10 is plunged into the product 8 contained inside.

Referring to FIGS. 4 and 4*a*, an applicator head 10 according to a first embodiment of the invention will now be described.

As can be seen in FIGS. 4 and 4*a*, the applicator head 10 comprises an elongate main body 11 defining a longitudinal axis X, and having a length L along this axis X. In the exemplary embodiment shown, the longitudinal axis X defined by the main body 11 of the applicator head 10 is rectilinear and coincides with the longitudinal axis defined by the neck 7 of the reservoir 3 when the applicator head 2 is brought to the storage position relative to said reservoir 3, and is an extension of the wand 9.

Alternatively, the longitudinal axis X defined by the main body 11 of the applicator head 10 could form an angle, particularly an angle of about 90°, with the wand 9 and with the longitudinal axis defined by the neck 7 of the reservoir 3.

In another embodiment, the longitudinal axis X defined by the main body 11 of the applicator head 10 could be curved and the applicator head could extend along this curved axis from the free end of the wand 9 to the end where it is attached.

The main body 11 of the applicator head 10 has a storage portion 110 intended to be loaded with product to be applied, and an application portion 111 intended for applying the product to a part of the user's body, in particular the eyelashes. Passages 113 are provided between the storage portion 110 and the application portion 111, connecting these portions and allowing the product 8 to travel towards the application portion 111 by capillary action when in the form of a hot and more or less viscous liquid.

In the embodiment illustrated in FIGS. 4 and 4*a*, the application portion of the main body 11 comprises two rows 111 of teeth 112, contained in or centered on a plane P containing the longitudinal axis X of the main body 11 of the head 10, and extending to either side of said axis X. Each tooth 112 has a cross-section substantially the shape of a pointed arch or substantially the shape of a spade of a card deck, and extends substantially radially relative to the longitudinal axis X. Moreover, the teeth 112 in a same row 111 are aligned one behind the other in an alignment direction substantially parallel to the longitudinal axis X.

Figure 5:
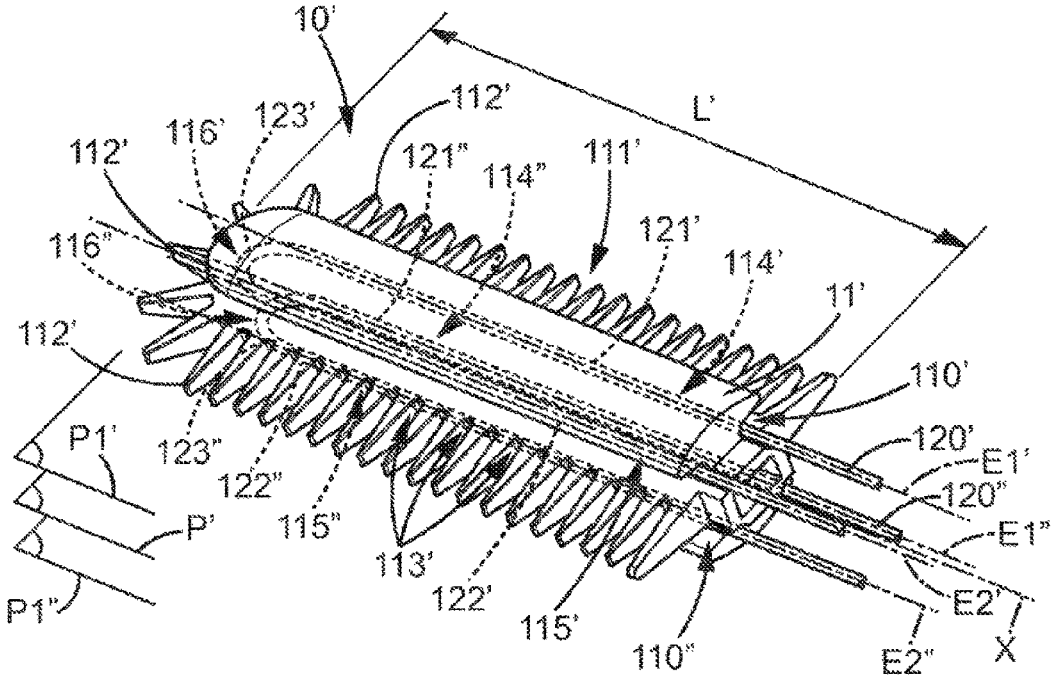
FIG. 5 is a view similar to that of FIG. 4, illustrating an applicator head according to a second embodiment of the invention.

In the various embodiments illustrated in the figures accompanying the present description, and as shown in particular in FIGS. 4, 4*a*, and 5, the product storage portion of the applicator head 10, 10' comprises a groove 110, 110', 110" formed in the main body 11, 11' of said head. This groove 110, 110', 110" has one or more main portions defining one or more rectilinear axes of extension E1, E2, E1', E2', E1", E2" which are substantially parallel to the longitudinal axis X which is also rectilinear, of the main body 11, 11' of the applicator head 10, 10'.

However, without departing from the scope of the invention, it is possible to have a main body of the applicator head having a rectilinear longitudinal axis and one or more main groove portions where the axis of extension is rectilinear and forms an angle with the longitudinal axis of the main body of the applicator head, or one or more main groove portions where the axis of extension is curved or zigzag.

Similarly, without departing from the scope of the invention, it is possible to have a main body of the applicator head having a curved longitudinal axis and one or more main groove portions where the axis of extension is also curved and may or may not be parallel to the longitudinal axis of the main body of the applicator head.

Figure 6:
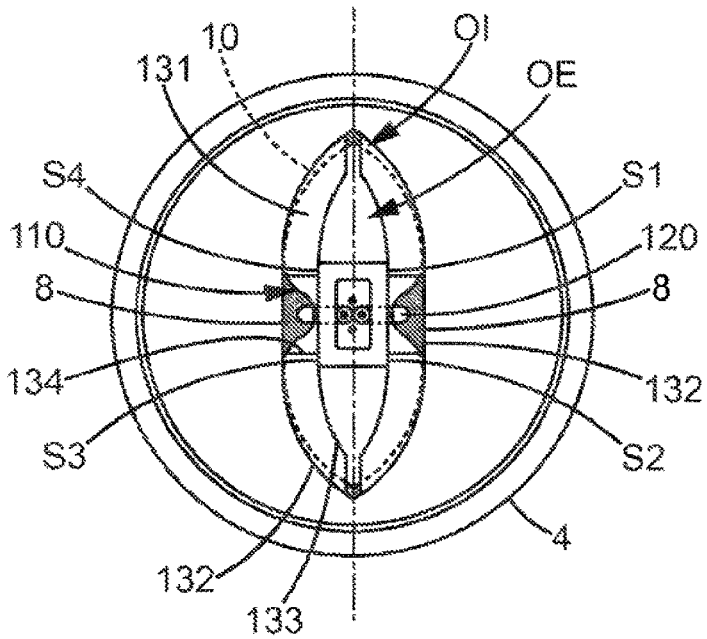
FIG. 6 is a sectional view along line VI-VI of FIG. 2.

Returning to the embodiment shown in particular in FIGS. 4, 4*a*, and 6, the product storage portion comprises a groove 110 formed in the main body 11. This groove 110 has two straight main portions 114, 115 each defining an axis of extension E1, E2 running substantially parallel to the longitudinal axis X of the main body 11. More specifically, the straight main portions 114, 115 of the groove 110 extend for a major portion of said length L of the main body 11 along the longitudinal axis X. In other words, the straight main portions of the groove 110 extend over most of the length L of the head 10. For example, the main portions 114, 115 of the groove 110 extend for at least 80%, preferably 100%, of the length L of the main body 11 of the applicator head 10 along the longitudinal axis X. In an advantageous arrangement, the straight main portions 114, 115 of the groove 110 extend for substantially the entire length of the main body 11 of the applicator head 10.

In addition, the applicator head 10 comprises a heating device 12 suitable for heating the product loaded on the applicator head 10 only at the product storage portion 110 formed by the groove 110, and comprising a heating element 120 lying within said groove 111.

According to the invention, the heating element comprises a resistance wire having a main portion extending along the axis of extension of the main portion of the groove, for the entire length of said main portion.

In the embodiment illustrated in FIGS. 4 and 4*a* together with FIG. 6, the groove 110 forming the product storage portion is U-shaped, having a base and two arms. As can be seen in particular in FIG. 4*a*, the arms of the U form first and second straight main portions 114, 115 defining axes of extension E1, E2 running substantially parallel to the longitudinal axis X for substantially the entire length L of the main body 11, and the base of the U is a curved portion 116 at the free end of main body 11 and connecting said straight main portions 114, 115.

As is particularly visible in FIG. 4, in this first embodiment the U-shaped groove constituting the product storage portion lies in a plane P1 containing the longitudinal axis X of the main body 11 and perpendicular to the rows 111 of teeth 112 of the application portion.

In this embodiment, passages 113 have been formed in the main body 11 to connect the product storage portion formed by the groove 110 and the application portion formed of the rows 111 of teeth 112. In the current case, these passages consist of channels 113, here open on the outside of the head 10, and connecting at one end to the groove 110 forming the product storage portion and at the other end to the spaces between each tooth 112. These channels 113 provide communication between the product storage portion and the application portion and allow the product 8 to travel by capillary action when in the form of a hot, more or less viscous liquid, from the storage portion 110 to the application portion 111.

According to the invention, the resistance wire forming the heating element has a main portion extending along the axis of extension of the main portion of the groove, for the entire length of said main portion of the groove.

As can be seen in FIGS. 4 and 4*a* together with FIG. 6, in a first embodiment of the invention, the resistance wire 120 forming the heating element has a U shape that matches that of the groove 110. In the illustrated embodiment, the resistance wire 120 is arranged on the main body 11 of the applicator head 10 so that it runs along the bottom of the groove 110. More particularly, the resistance wire used has a first rectilinear main portion 121 extending along the axis of extension E1 of the first straight main portion 114 of the groove 110, for the entire length thereof 114, a second rectilinear main portion 122 extending along the axis of extension E2 of the second straight main portion 115 of the groove 110, for the entire length thereof 115, and a curved portion 116 extending along the curved portion 116 of the groove 110.

Thus in this first embodiment, as is particularly visible in FIGS. 4 and 4*a*, the axis of extension E1, E2 of each main portion 114, 115 of the groove 110 coincides with the axis along which each main portion 121, 122 of the resistance wire 120 extends.

Still in relation to these FIGS. 4 and 4*a*, the wand 9 is hollow and the end of the wand 9 supporting the applicator head 10 has two holes 90 lying in the same plane P1 as the groove 110 and the resistance wire 120, and through which the ends of said wire 120 can be inserted for connection to conductive wires 18 placed within the rod 9 and connecting said resistance wire 120 to the power supply device 15. Preferably, this connection is in the form of spot welds S made near the head 10 so as to limit the heating of the wand by the resistance wire 120 and to prevent the product 8, particularly when the latter is in powder form, from liquefying and adhering to said wand 9 when the resistance wire 120 receives electricity from the power supply device 15.

It is also possible to implement a head/wand electrical connection without spot welds S between the ends of the wires 120 and 18 but with contact between two conductive areas, typically two electrodes with one located on the head and the another on the wand, respectively connected to these same wires 120 and 18.

In such an embodiment with an electrical connection by contact, it is possible to removably connect the applicator head 10 and the wand 9 by any known connecting means comprising an electrical connection by contact. With such arrangements, it is possible to have a removable applicator head 10 that can be changed or cleaned.

Furthermore, as is particularly visible in FIG. 4*a*, the groove 110 forming the product storage portion of the applicator head 10 has a housing 117 suitable for accommodating a temperature sensor 19 connected to the control circuit of the applicator device 2 via conductive wires 18 and suitable for regulating the temperature to which the resistance wire 120 is heated. This housing 117 extends inward into the main body 11 from the bottom of the groove, substantially at the middle of the applicator head 10 along the longitudinal axis X, and opens into an inside space 118 formed inside the main body 11.

In the embodiment illustrated in this FIG. 4*a*, the inside space 118 defines a receiving housing into which the wand 9 can be inserted, for example press-fitted, when assembling said wand 9 and the applicator head 10. In this case, the wand 9 has one or more passages, such as a window 91 facing the housing 117 and suitable for allowing the passage of the conductive wires 18 connecting the temperature sensor 19 to the control circuit of the applicator device 2. The sensor 19 may advantageously be received within the housing 117 and retained by press-fitting, and/or may press against the edges of the window 91 formed in the wand 9 while being held inside the housing 117 by the conductive wires 18 which run inside the wand 9 after passing through the window 91.

FIG. 5 illustrates a second embodiment of an applicator head according to the present invention.

In this FIG. 5, the applicator head 10' has an application portion formed of a single row 111' of teeth 112', lying substantially in a plane P' containing the longitudinal axis X of the main body 11, and having the general shape of a U centered on said longitudinal axis X.

The applicator head 10' according to this second embodiment further comprises two U-shaped grooves 110', 110" forming the product storage portion, one running on each side of the row 111' of teeth 112' in planes PI' and PI" which are at a distance from the longitudinal axis X and are parallel to plane P where the row 111' of teeth 112' lies.

In this embodiment, the head 10' is provided with two heating elements in the form of two resistance wires 120', 120" having a U shape which corresponds to that of the grooves 110', 110" where they lie.

Similarly to what has been described in relation to FIGS. 4 and 4*a* and which will not be further described here, the resistance wires 120', 120" forming the heating elements of the applicator head 10' according to this second embodiment penetrate the wand and connect at their free ends, for example by means of spot welds, to conductive wires coupling said wires 120', 120" to the power supply device 15.

Similarly to what was explained in detail in relation to the first embodiment of the applicator head 10, the two grooves 110', 110" forming the product storage portion of the applicator head 10' of the second embodiment illustrated in FIG. 5 each have the shape of a U comprising two arms 114', 115', 114", 115" forming straight main portions each defining an axis of extension E1', E2', E1", E2" running substantially parallel to the longitudinal axis X of the main body 11 and extending over the major portion, meaning at least 80%, and preferably for substantially the entire length L' of the main body 11' along the longitudinal axis X, and a curved portion 116', 116" connecting said respective straight main portions 114', 115', 114", 115". The resistance wires 120', 120" used in the applicator head 10 according to this second embodiment have a U shape intended to cooperate with a respective groove 110', 110", and each comprises two rectilinear main portions 121', 122', 121", 122" forming the arms of the U and extending along the axes of extension E1', E2', E1', E2" of the respective straight main portions 114', 115', 114", 115" of the grooves 110', 110", for the entire length of said respective straight main portions 114', 115', 114", 115" of the grooves 110', 110", as well as a curved portion 123', 123" forming the base of the U connecting the respective rectilinear main portions 121', 122', 121", 122" and extending along the curved portion 116', 116" of the grooves 110', 110".

Thus in this second embodiment, as is particularly visible in FIG. 5, the axis of extension E1', E2', E1', E2" of each main portion 114', 115', 114", 115" of the groove 110' coincides with the axis along which each main portion 121', 122', 121", 122" of each resistance wire 120', 120" extends.

In this second embodiment illustrated in FIG. 5, the passages connecting the storage portions formed of U-shaped grooves 110', 110" and the application portion formed of the row 111' of teeth 112', said row here also being U-shaped, are directly defined by the spaces 113' between the teeth 112' and opening into said grooves 110', 110".

In either of the embodiments illustrated in FIGS. 4, 4*a*, and 5, the applicator head 10, 10' has a non-circular cross-section. Thus, according to a particularly advantageous feature of the invention, and as shown in FIGS. 2 and 6, the neck 7 of the reservoir 3 is provided with a wiper member 13 defining an insertion opening OI substantially corresponding to the combined cross-sections of the wand 9 and the applicator head 10, in order to guide and direct the insertion of the applicator device 2 comprising the applicator head 10 into the reservoir 3.

In the embodiment illustrated in these FIGS. 2 and 6, the cross-section of the applicator head 10 includes the cross-section of the wand 9 at the end where it is attached. In this case, the combined cross-sections of the wand 9 and head 10 correspond to the cross-section of the head 10. Thus, as is particularly visible in FIG. 6, the wiper member 13 arranged at the neck 7 of the reservoir 3 has an insertion opening OI whose cross-section substantially corresponds to the cross-section of the head 10.

More specifically, and as is clearly visible in FIG. 6, the cross-section of the insertion opening OI of the wiper member 13 has a contour 132 which substantially follows the contour of the cross-section of the head 10, the insertion opening OI preferably being slightly larger overall to facilitate inserting the head 10 through the insertion opening OI, except at the product storage portion formed by the groove 110 so that the head 10 can be withdrawn from the reservoir 3 through the wiper member 13 while retaining the product 8 in the storage portion formed by the groove 110. In other words, the contour 132 of the cross-section of the insertion opening OI has no projecting part extending into the groove 110 when the applicator head 10 is traversing the wiper member 13.

Furthermore, the wiper member 13 comprises a wiper lip 131 that allows the wand 9 and applicator head 10 to pass over it and that removes the excess product 8 on said head 10 and/or clinging to the wand 9 as the applicator device 2 is withdrawn from the reservoir 3.

Thus, in the embodiment illustrated in FIG. 6, the wiper lip 131 defines a wiper opening OE having a cross-section of a shape generally similar to that of the insertion opening OI but of smaller dimensions in order to obtain the effect of wiping the head 10, and a contour 133 suitable for removing excess product 8 loaded on the head 10 and for leaving the product 8 loaded on the head 10 at the product storage portion formed by the groove 110. For this purpose, the contour 133 of the wiper opening OE has recesses 134 and corresponds to the contour 132 of the insertion opening OI in the areas facing the groove 110 of the head 10.

Furthermore, in the embodiments illustrated, as the applicator head 10, 10' has a non-circular cross section, it is necessary to ensure that the applicator head 10, 10' of the applicator device 2 always remains angularly aligned with the insertion opening OI and wiper opening OE of the wiper member 13 when said applicator device 2 is in place inside the reservoir 3. If such were not the case, withdrawing the applicator head 10, 10' from the reservoir 3 through the wiper member would require the user to rely on trial and error to angularly align the applicator head 10, 10' of the applicator device 2 with the insertion opening OI and wiper opening OE of the wiper member 13, which would make such a withdrawal particularly tedious and would impact the ergonomics and ease of use of the system for packaging and applying a product 1.

Therefore, according to an advantageous embodiment of the invention, the wiper member 13 is mounted so as to rotate freely within the neck 7 of the reservoir 3, and said wiper member 13 and the applicator device 2 have indexing elements that mutually index said wiper member 13 and said applicator device 2 in rotation, so that the applicator head 10, 10' of the applicator device 2 is always aligned angularly with the insertion opening OI and wiper opening OE of the wiper member 13 when said applicator device 2 is inserted into the reservoir 3.

Thus, and as can be seen in FIG. 2, the wiper member 13 can be mounted with some play in the neck 7 of the reservoir 3 so that is freely rotatable within said neck, by means of an outer cylindrical skirt 130 equipped in the radial direction with an annular flange 135 arranged to press against the upper surface of the neck 7 of the reservoir 3 and one or more catches 136 intended to cooperate with the reservoir 3 so as to retain the wiper member 13 within the neck 7 of the reservoir 3 in the axial direction X.

In addition, and as shown in particular in FIG. 6, the wand 9 of the applicator device 2 may have a non-circular cross-section. In this case, the cross-section of the wand 9 has a substantially rectangular shape.

Thus, in the embodiment illustrated in this FIG. 6, the rotation indexing member provided on the applicator device 2 is formed by the wand 9 and the rotation indexing member provided on the wiper member 13 is formed by the wiper lip 131 which comes into contact with the wand 9 in at least three, and in the current case four, contact segments S1 to S4 when the applicator device 2 is inserted into the reservoir 3 and the applicator head 10 has traversed the wiper member 13 beyond the wiper opening OE.

Alternatively, it is possible to equip the applicator device 2 with a wand 9 having a generally cylindrical cross-section and to provide on said wand 9 a longitudinal rib extending projecting in the radial direction and cooperating with the recess 134 formed in the wiper opening OE of the wiper member 13.

According to an advantageous embodiment of the invention, the main body 11, 11' of the applicator head 10, 10' has a rigid core and the application portion 111, 111' is made of a flexible material, in particular with the aim of a more pleasant application experience, preferably of silicone, particularly a silicone resistant to a heat of about 200° C., or some other elastomer, said application portion advantageously being co-injected with the rigid core or overmolded thereon.

In an alternative embodiment, the head is entirely made of a flexible material such as silicone or some other elastomer.

The resistance wire or wires serving as the heating element may be made of a metal, a ceramic, or a similar material, and may have a circular cross-section having a diameter of between 0.1 and 1 mm, for example about 0.3 mm.

A cycle in the operation of the system 1 for packaging and applying a cosmetic product according to the invention will now be described, with reference to the accompanying figures.

Starting from the configuration illustrated in FIGS. 1 and 2, a user grips the applicator device 2 by the elongate body 4 and unscrews this element from the neck 7 of the reservoir 3.

The contact sensor 17 arranged inside the body 4 detects that the device has been opened, and closes the circuit which controls the supply of power to the heating element 120 that is part of the heating device 12 equipping the applicator head 10 and is in the form of one or more resistance wires 120, 120', 120".

The resistance wire or wires 120, 120', 120" are then supplied with electricity, possibly after a certain time delay of for example 5 to 10 sec, and begin to heat. The green indicator light 5 turns on and remains on as long as the resistance wire or wires 120, 120', 120" are receiving electricity, or flashes to indicate that the temperature of said wires is rising, then remains lit once the wires have reached their setpoint temperature, for example about 40° C. to 80° C., and preferably 50° C. to 70° C. The maintaining of these heating elements at their setpoint temperature may be regulated by means of the temperature sensor 19 arranged in the applicator head 10.

The applicator head 10, carrying the resistance wire or wires 120, 120', 120" arranged inside a respective groove 110, 110', 110", and attached to, for example press-fitted onto, the end of the wand 9, is then loaded with product 8. This product, which is in the form of a more or less viscous liquid or a powder at room temperature, adheres to the head 10 and accumulates in the recesses provided therein, and in particular within the storage portion, meaning in the groove or grooves 110, 110', 110" receiving the respective resistance wire or wires 120, 120', 120".

When the user continues the movement of withdrawing the applicator device 2 from the reservoir 3, the applicator head 10 reaches the wiper member 13 mounted so as to rotate freely at the neck 7 of the reservoir 3. Because the applicator device 2 and the wiper member 13 are angularly indexed by the contact of the wand 9 and wiper lip 131 at four contact segments S1 to S4, the applicator head 10 is angularly aligned with the wiper opening OE of the wiper member 13.

The applicator head 10 "roughly" loaded with product 8 then passes through this wiper opening OE, and the wiper lip 131 bends outward in the radial direction, this bending possibly facilitated by the presence of radial slits in the wiper lip 131 as shown in FIG. 6, and removes the excess product 8 loaded on the head 10, while leaving by means of the recesses 134 a calibrated amount of product 8 located inside the groove or grooves 110, 110', 110" and in contact with the wire or wires 120, 120', 120". During this wiping phase, when the head 10 is made of a flexible material or has at least one portion made of flexible material, the application portion formed by the row or rows 111, 111' of teeth 112, 112', the head, or the flexible portion of the head 10 may also be made to bend during traversal of the wiper opening OE.

The head 10 then passes through the insertion opening OI of the wiper member 13, following the wiper lip 131 as it flares radially outward relative to the longitudinal axis X defined by the neck 7 of the reservoir 3 between the wiper opening OE and the insertion opening OI.

When the wire or wires 120, 120', 120", which lie substantially rectilinearly within the one or more grooves where they are arranged, have reached a predetermined temperature, for example after a period of 10 to 15 sec, the product 8 housed within the storage portion formed by the one or more grooves 110, 110', 110" starts to liquefy and spread, traveling by capillary action over the head 10 and more particularly over the application portion formed by the row or rows 111, 111' of teeth 112, 112' via the passages provided in the form of channels 113 connecting the one or more grooves 110, 110', 110" to the spaces between the teeth 112, 112', or directly formed by the spaces between the teeth.

According to the invention, the resistance wire or wires 120, 120', 120" lying within the one or more grooves 110, 110', 110", and in particular the rectilinear main portions 121, 122, 121', 122', 121", 122" of the resistance wire or wires 120, 120', 120" extending for the entire length of the straight main portions 114, 115, 114', 115', 114", 115" of the one or more grooves 110, 110', 110", which themselves extend for a major portion, meaning for example at least 80% of the length L, L' and preferably for substantially the entire length L, L' of the main body 11 of the head 10, have a shorter length in comparison to the heating elements used in known devices, which allows obtaining a rapid temperature increase that requires little energy, as well as an advantageously rapid cooling as mentioned above.

In the applicator head 10 according to the first embodiment, the resistance wire 120 thus has a length when straightened of about twice the length L of the main body 11 of the head 10 (to which must be added the length of the curved portion 123 in particular).

In the applicator head 10' according to the second embodiment, the resistance wires 120', 120" each have a length when straightened of about twice the length L of the main body 11' of the head 10' (to which must be added the length of the curved portion 123', 123" in particular). Thus, in this embodiment, the resistance wires travel the length L of the main body 11' of the head 10' at least four times.

The user then brings the applicator head 10, 10' towards the area where she wishes to apply the product 8, particularly towards the eyelashes when the product is mascara, and applies the product 8 loaded on the head 10 in the one or more grooves 110, 110', 110" and heated via the resistance wire or wires 120, 120', 120", by means of the row or rows 111, 111' of teeth 112, 112'.

Once the application is complete, the user returns the applicator device 2 to the storage position within the reservoir 3. For this purpose, the user places the applicator head 10, 10' facing the insertion opening OI of the wiper member, and inserts said head 10, 10' into the reservoir 3 while being guided and directed by the contours 132 of said opening OI which has a shape substantially corresponding to the combined cross-sections of the head 10, 10' and wand 9.

Once the head 10, 10' has passed through the wiper member 13 beyond the wiper opening OE, the wiper lip 131 bends back by elastic return and comes into contact with the wand 9 at contact segments S1-S4 so as to rotationally couple the applicator device 2 and the wiper member 13, and maintain the angular alignment between the applicator head 10, 10' and the wiper opening OE and insertion opening OI when said applicator device 2 is returned to the storage position relative to said reservoir 3.

The user then attaches the elongate body 4 forming a cap onto the neck 7 of the reservoir 3, in this case by screwing it on. During this phase, the contact sensor 17 present on the cap 4 comes into contact with the annular flange 135 of the wiper member 13 and opens the circuit supplying power to the heating element 120, 120', 120", breaking the connection between the power supply device formed by the battery 15 and said heating element 120, 120', 120" and therefore stopping the heating.

Although this description has been made in relation to two particular embodiments, other embodiments can be envisaged without departing from the scope of the invention.

Thus, in the embodiments described above, the longitudinal axis X of the main body of the applicator head, as well as the various axes of extension E1, E2, E1', E2', E1', E2" of the main portions of the one or more grooves 110, 110', 110", have been described as being rectilinear and parallel to each other.

However, a main body of the applicator head could be designed that has a curved, wavy, or zigzag longitudinal axis, and that is provided with one or more grooves in which the main portions have extension axes that are also curved, or wavy or zigzag, and may or may not be parallel to the longitudinal axis of the main body of the head. The main portion or portions of the resistance wire or wires will then have a curved, zigzag, or wavy shape, corresponding to the shape(s) of the main groove portion or portions in which they lie.

The invention claimed is:

1. A system for packaging and applying a cosmetic product, comprising:

a reservoir for containing a cosmetic product and having a neck defining a longitudinal axis; and an applicator device comprising:

a body suitable for being held in the hand;

an applicator head;

a rod connecting the body and the applicator head;

the applicator head comprising:

a main body defining a longitudinal axis and comprising a storage portion adapted to be loaded with product and an application portion adapted to apply the product, passages being provided between the storage portion and the application portion, the storage portion comprising a groove having a main portion defining an axis of extension, the main body of the head having a certain length along the longitudinal axis and the main portion of the groove extending over a major portion of the length of the main body;

a heating device adapted to heat the cosmetic product loaded on the applicator head, the heating device comprising a heating element lying within the groove;

wherein the body is adapted to close the reservoir and the rod is adapted to penetrate the reservoir when said body closes the reservoir;

wherein the heating element comprises a resistance wire having a main portion extending along the axis of extension of the main portion of the groove, over the entire length of the main portion of the groove;

wherein the application portion comprises at least one row of teeth aligned in an alignment direction parallel to the longitudinal axis, the passages being formed by and/or opening into the spaces between the teeth;

wherein the groove lies in a plane distanced from the longitudinal axis and parallel to the row of teeth of the application portion; and wherein the row of teeth has the general shape of a U centered on the longitudinal axis, the storage portion comprises two grooves that run one on each side of the row of teeth, and the heating device comprises two heating elements that lie within the grooves.

2. The system according to claim 1, wherein the main portion of each groove extends over at least 80% of the entire length of the main body.

3. The system according to claim 1, wherein the axis of extension of the main portion of each groove is parallel to the longitudinal axis of the main body.

4. The system according to claim 1, wherein the application portion comprises at least one row of teeth aligned in an alignment direction parallel to the longitudinal axis, the passages being formed by and/or opening into the spaces between the teeth.

5. The system according to claim 4, wherein the groove lies in a plane containing the longitudinal axis and perpendicular to the row of teeth of the application portion.

6. The system according to claim 4, wherein the groove lies in a plane distanced from the longitudinal axis and parallel to the row of teeth of the application portion.

7. The system according to claim 1, wherein the main portion of the groove is straight and the main portion of the resistance wire is rectilinear.

8. The system according to claim 7, wherein the main body has a first end connected to the rod and a second free end, the groove has the shape of a U comprising a base and two arms, said base being at the free end of the main body and said arms forming two main portions, and the heating element has a U shape which corresponds to that of said groove.

9. The system according to claim 1, further comprising a power supply device for supplying electric power to the heating element.

10. The system according to claim 1, wherein the neck of the reservoir is provided with a wiper member adapted to wipe at least the applicator head.

11. The system according to claim 10, wherein the applicator head has a non-circular cross-section, and the wiper member comprises an insertion opening having a cross-section corresponding to the combined cross-sections of the rod and applicator head, said wiper member further comprising a wiper lip suitable for removing the excess cosmetic product loaded on the rod and applicator head as the applicator device is withdrawn from the reservoir.

12. The system according to claim 10, wherein the wiper member is mounted so as to rotate freely within the neck of the reservoir, and said wiper member and the applicator device comprise indexing elements adapted to mutually index the wiper member and applicator device rotationally.

13. The system according to claim 1, wherein the reservoir contains a cosmetic product in powder form intended to be heated for application to keratin fibers, particularly to eyelashes.

14. The system according to claim 1, wherein the reservoir contains a cosmetic product and wherein the cosmetic product is mascara.

15. A method of using a system for packaging and applying a cosmetic product, comprising: providing the system of claim 1, wherein the reservoir contains a cosmetic product in powder form; and applying the cosmetic product to keratin fibers.

* * * * *